United States Patent [19]

Heinhold et al.

[11] Patent Number: 5,067,819

[45] Date of Patent: Nov. 26, 1991

[54] CLEANING AND SANITIZING SYSTEM FOR FROZEN DESSERT MIXING MACHINE

[76] Inventors: Duane H. Heinhold, 412 W. 2300 South, Bountiful, Utah 84010; Kenneth E. Heinhold, 3015 Chaucer Pl., Salt Lake City, Utah 84108

[21] Appl. No.: 522,664

[22] Filed: May 11, 1990

[51] Int. Cl.[5] ..... B01F 7/24; B08B 3/02

[52] U.S. Cl. ..... 366/138; 366/203; 366/197; 134/104.1

[58] Field of Search ..... 134/150, 115, 104.1; 366/279, 286, 197, 199, 203, 207, 138

[56] References Cited

U.S. PATENT DOCUMENTS

| | | | |
|---|---|---|---|
| 1,968,994 | 8/1934 | Davies | 366/138 |
| 2,849,215 | 8/1958 | Hurst | 366/138 |
| 3,223,485 | 12/1965 | Ferrari et al. | 366/138 X |
| 3,365,177 | 1/1968 | Daman | 366/138 |
| 3,495,808 | 2/1970 | Klein et al. | 366/138 |
| 4,194,842 | 3/1980 | Puthawala | 366/138 X |
| 4,404,168 | 9/1983 | Baumberger | 366/138 X |
| 4,446,185 | 4/1984 | Wilste | 134/115 R |
| 4,740,088 | 4/1988 | Kelly, Jr. | 366/138 |
| 4,750,844 | 6/1988 | Stevenett | 366/138 |

FOREIGN PATENT DOCUMENTS

| | | | |
|---|---|---|---|
| 1419805 | 12/1975 | United Kingdom | 366/138 |

*Primary Examiner*—Frankie L. Stinson
*Attorney, Agent, or Firm*—Terry M. Crellin

[57] ABSTRACT

Improvements are provided in machines for processing frozen comestibles of the type in which a frozen comestible is placed in a mixing cup and the mixing cup is moved toward an auger which mixes the frozen comestible into a smooth, soft material. The improvements comprise at least one orifice in a sidewall of the mixing cone and a system for delivering a cleaning and sanitizing solution through the orifice to spray the solution into the interior of the mixing cone. As the mixing cone is moved up and down, the cleaning and sanitizing solution is sprayed into the mixing cone and impinges on the auger to clean and sanitize the auger and the interior of the mixing cone. The system for delivering the cleaning and sanitizing solution preferably comprises a manifold having a hollow interior, with a plurality of orifices in the sidewall of the mixing cone which communicate with the hollow interior of the manifold. The manifold is positioned adjacent to the exterior surface of the sidewall of the mixing cone. A conduit delivers the cleaning and sanitizing solution under pressure into the hollow interior of the manifold, and the cleaning and sanitizing solution is sprayed through the orifices into the mixing cone.

8 Claims, 4 Drawing Sheets

CLEANING AND SANITIZING SYSTEM FOR FROZEN DESSERT MIXING MACHINE

BACKGROUND OF THE INVENTION

1. Field of the Invention

The present invention relates to machines for mixing a frozen dessert in which various condiments and flavors are mixed in a given portion of a frozen material such as ice cream. In particular, the invention relates to improvements in means incorporated with the mixing cone of such machines for cleaning and sanitizing the mixing cone and mixing auger.

2. State of the Art

Machines are well known in the prior art for mixing and transforming a hard frozen ice cream product to a substantially soft, smooth, creamy product which is superior in quality to conventional soft ice creams. Such machines are disclosed in our copending U.S. application Ser. No. 07,215,820, filed July 6, 1988, in which a variety of condiments such as pieces of candy, fruit, nuts, cookies and other flavors can be rapidly mixed with the ice cream in single serve portions.

As a result of a search of the relevant prior U.S. patents, the following patents were found which relate to similar machines of the type to which the present invention pertains:

| | | | | |
|---|---|---|---|---|
| 2,626,132 | 2,626,133 | 3,061,279 | 4,448,114 | 4,506,988 |
| 4,548,508 | 4,637,221 | 4,647,214 | 4,693,611 | 4,708,489 |

3. Objectives

A principal objective of the present invention is to provide an improved system for cleaning and sanitizing the mixing cone and mixing auger of a frozen dessert mixing machine, wherein the improved system is simple in construction yet rugged and efficient in use.

An additional objective of the present invention is to provide an improved mounting mechanism for mounting the mixing cone to the transport means that moves the mixing cone, wherein novel coupling means are provided in the mounting mechanism for connecting s supply of cleaning and sanitizing solution to the mixing cone, and further wherein a check valve is provided in the coupling means to prevent backflow of matter from the mixing cone into the supply of cleaning and sanitizing solution.

A further objective of the present invention is to provide a basin beneath the mixing cone for collecting the cleaning and sanitizing solution used in cleaning and sanitizing the mixing cone and mixing auger.

BRIEF DESCRIPTION OF THE INVENTION

The above objectives are achieved in accordance with the present invention by providing novel improvements to the conventional machines for mixing a frozen dessert of the prior art. Because the basic mixing machines are well documented in the prior art, detailed description of the machines will not be repeated in this specification. For purposes of detailed descriptions of the basic mixing machines, the reader is referred to our copending application, Ser. No. 07,215,820, filed July 6, 1988 and the prior art patents listed above.

In accordance with the present invention, an improved mixing cone is provided for an otherwise conventional frozen dessert mixing machine. The improved mixing cone comprises means for introducing a cleaning and sanitizing solution into the interior of the mixing cone. The cleaning and sanitizing solution is sprayed directly on the mixing auger and the auger redirects the solution against the interior walls of the mixing cone.

In a preferred embodiment of the invention, improved mounting means are also provided for mounting the mixing cone to the carriage that moves the mixing cone toward and away from the mixing auger. The carriage has a nipple to which a supply line is connected. The supply line in turn is connected to a source of the cleaning and sanitizing solution. Coupling means are provided for connecting the nipple on the carriage to the cleaning system of the mixing cone when the mixing cone is mounted on the carriage. The coupling means includes a check valve that prevents backflow of frozen dessert material from the mixing cone to the supply line from the source of the cleaning and sanitizing solution. The supply line advantageously comprises a water line attached to a pressurized source of potable water. A mixing valve is incorporated in the water line for injecting the proper amount of sanitizing agent into the water as the water flows through the mixing valve. The sanitizing agent mixes with the water in the water line to form the cleaning and sanitizing solution that is fed to the mixing cone.

In a still further embodiment of the invention, a basin is provided below the mixing cone for collecting the cleaning and sanitizing solution as that solution drains from the mixing cone. The basin can be connected directly to a drain, waste, vent system (a sewer system) or to a holding tank that is periodically emptied.

Additional objects and features of the invention will become apparent from the following detailed description, taken together with the accompanying drawings.

THE DRAWINGS

Preferred embodiments of the present invention representing the best modes presently contemplated of carrying out the invention are illustrated in the accompanying drawings in which.

DETAILED DESCRIPTION OF THE ILLUSTRATED EMBODIMENTS

Figure 1:
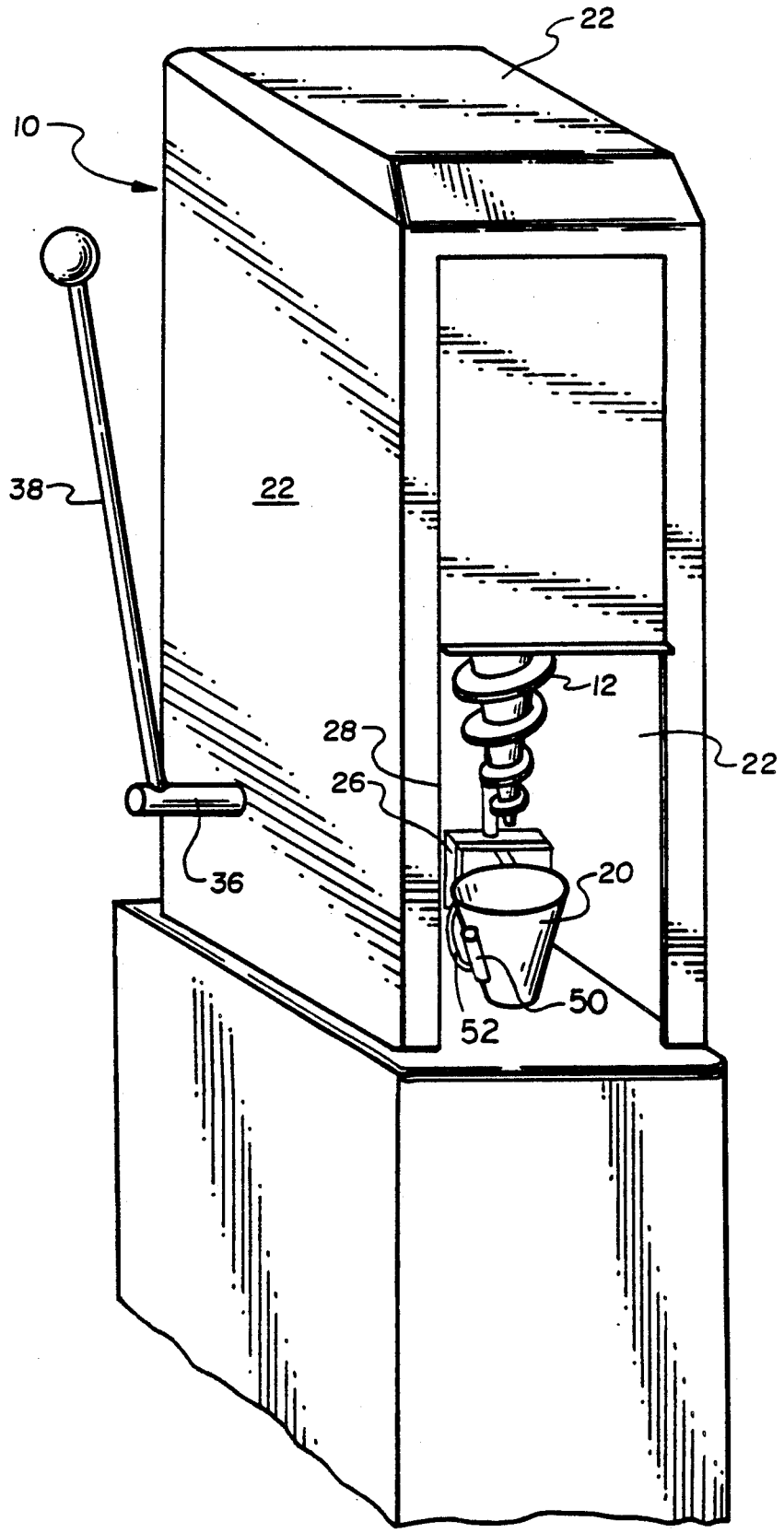
FIG. 1 is a pictorial representation of a mixing machine of the present invention.

Preferred embodiments of a frozen comestible mixing device 10 in accordance with the present invention are illustrated in the drawings. The apparatus 10 includes a mixing auger 12 and a motor 14, pulley system 16 and drive shaft 18 for driving the auger 12. A mixing cone 20 is provided in coaxial alignment with the mixing auger 12, and a housing 22 is provided for the apparatus. The apparatus, including the auger 12, the motor 14, pulley system 16, drive shaft 18, housing 22 and a standard mixing cone is conventional and well known in the prior art. The prior art as referred to hereinbefore gives a full and complete description of the general makeup and operation of such mixing apparatus.

Figure 3:
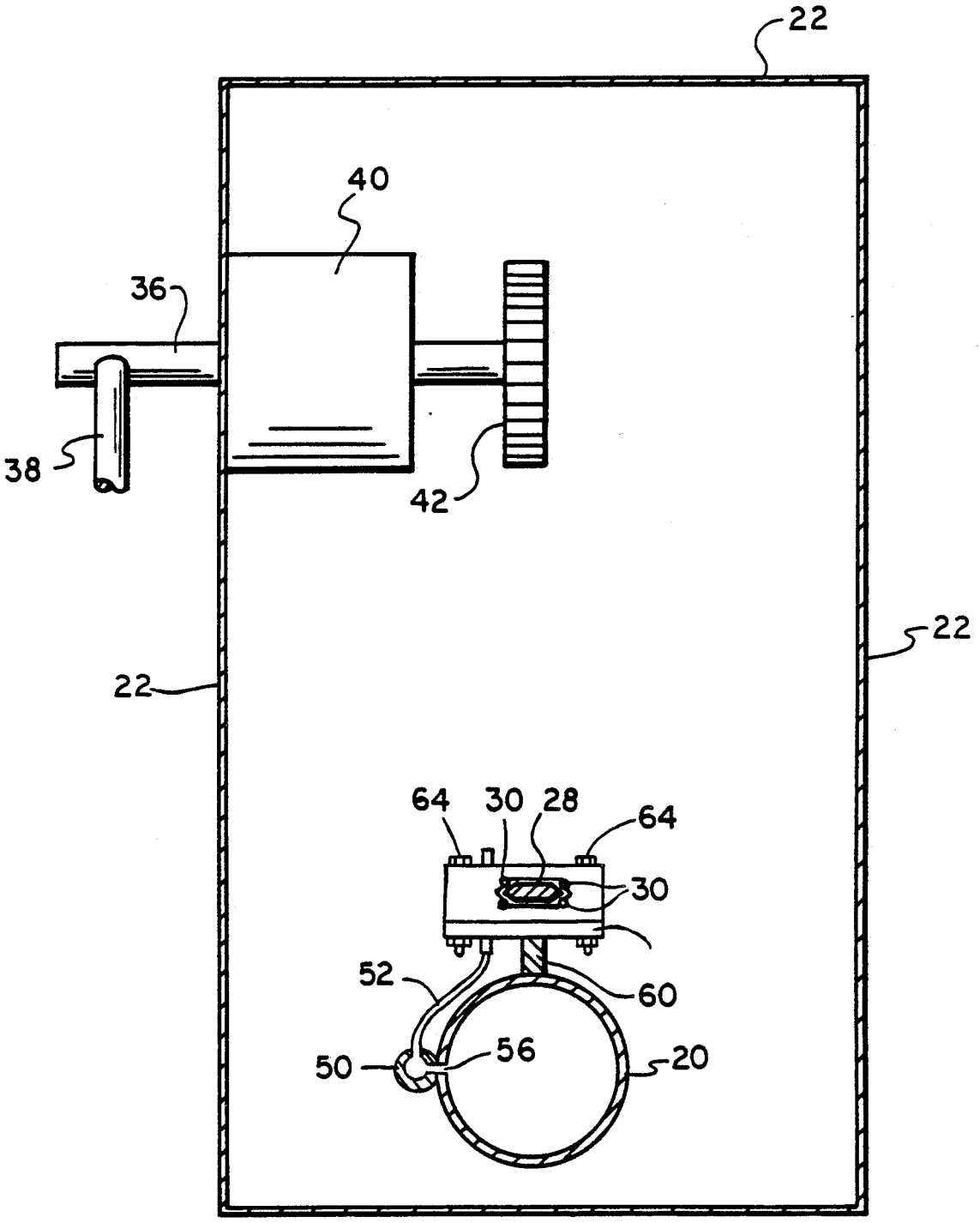
FIG. 3 is a cross section through the machine of FIG. 2 taken along line 3—3 of FIG. 2.

Briefly, conventional mixing apparatus of the prior art includes a mixing cone attached to a carriage that travels upwardly and downwardly along a vertical support post. As illustrated, the mixing cone 20 and carriage 26 incorporate novel improvements that will be described fully hereinafter. It is conventional to mount the carriage 20 on a rigid, elongate track 28 for linear, reciprocating movement toward and away from the auger 12. The carriage 26 is designed to move along the track 28 with a minimum of frictional resistance. To this end, as illustrated in FIG. 3, it is advantageous to provide a track 28 having parallel, spaced side edges which form a race for ball bearings 30 mounted within the carriage 26.

A gear mechanism 40 is provided within the housing 22, with the drive shaft 36 of the gear mechanism 40 extending from the gear mechanism 40 through a side wall of the housing 22. A lever 38 in turn extends from the drive shaft 36 to be positioned adjacent to but spaced slightly from the side of the housing 22 such that the lever can be moved in a pivotal movement about the drive shaft 36. The gear mechanism 40 further has an output drive sprocket 42 which is driven in rotational motion upon pivotal movement of the lever 38.

An upper idler sprocket 32 is positioned above the auger 12 and generally in line with the longitudinal length of the track 28. A drive chain 34 is connected at one end to the carriage 26, with the drive chain 34 extending from the carriage 26 around the upper idler sprocket 32 to the drive sprocket 42 of the gear mechanism 40. When the lever 38 of the gear mechanism 40 is moved downwardly in a first pivotal movement, the drive chain 34 wraps about the drive sprocket 42 so as to move the carriage 26 and the mixing cone 20 mounted thereon in linear movement toward the auger 12.

Figure 4:
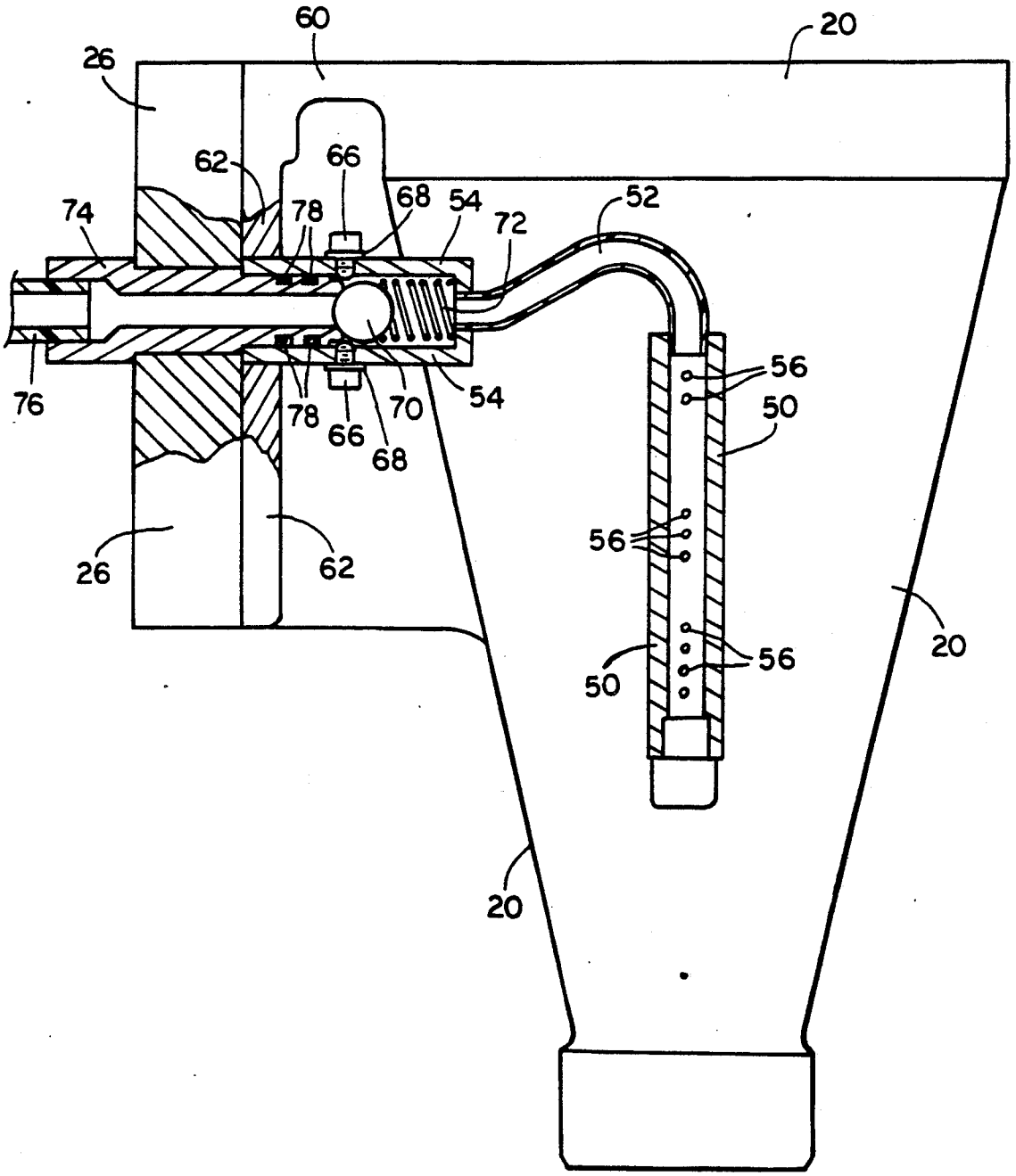
FIG. 4 is a side view of the mixing cone showing the system for providing cleaning and sanitizing solution to the mixing cone in section.

In a preferred aspect of the present invention, there is provided an improved mixing cone 20. The improvement comprises means for injecting a cleaning and sanitizing solution into the mixing cone 20 through a sidewall of the mixing cone 20. As illustrated in FIGS. 1, 3 and 4, a hollow, elongate manifold 50 is positioned along the sidewall of the mixing cone 20. A short piece of conduit 52 is attached between the hollow manifold 50 and a coupling member 54 which is associated with the carriage 26.

A series of relatively small openings 56 are provided in the sidewall of the mixing cone 20 to communicate with the hollow manifold 50. When the cleaning and sanitizing solution is delivered to the manifold 50 through the conduit 52 under pressure, the solution is sprayed through the openings 56 into the interior of the mixing cone 20. While the solution is being sprayed from the opening 56, the mixing cone 20 can be moved up and down to distribute the sprayed solution over the auger 12 to clean the auger 12. By using a sanitizing solution, bacteria can be effectively killed even within the small openings 56 and in the manifold 50 and conduit 52.

To prevent backflow of frozen comestible from the mixing cone beyond the coupling member 54 during normal use of the machine in making a mixed, frozen dessert, a check valve is advantageously provided in the coupling member. A particularly advantageous system for incorporating the check valve into the coupling member and for mounting the coupling member to the carriage 26 will now be described.

Figure 2:
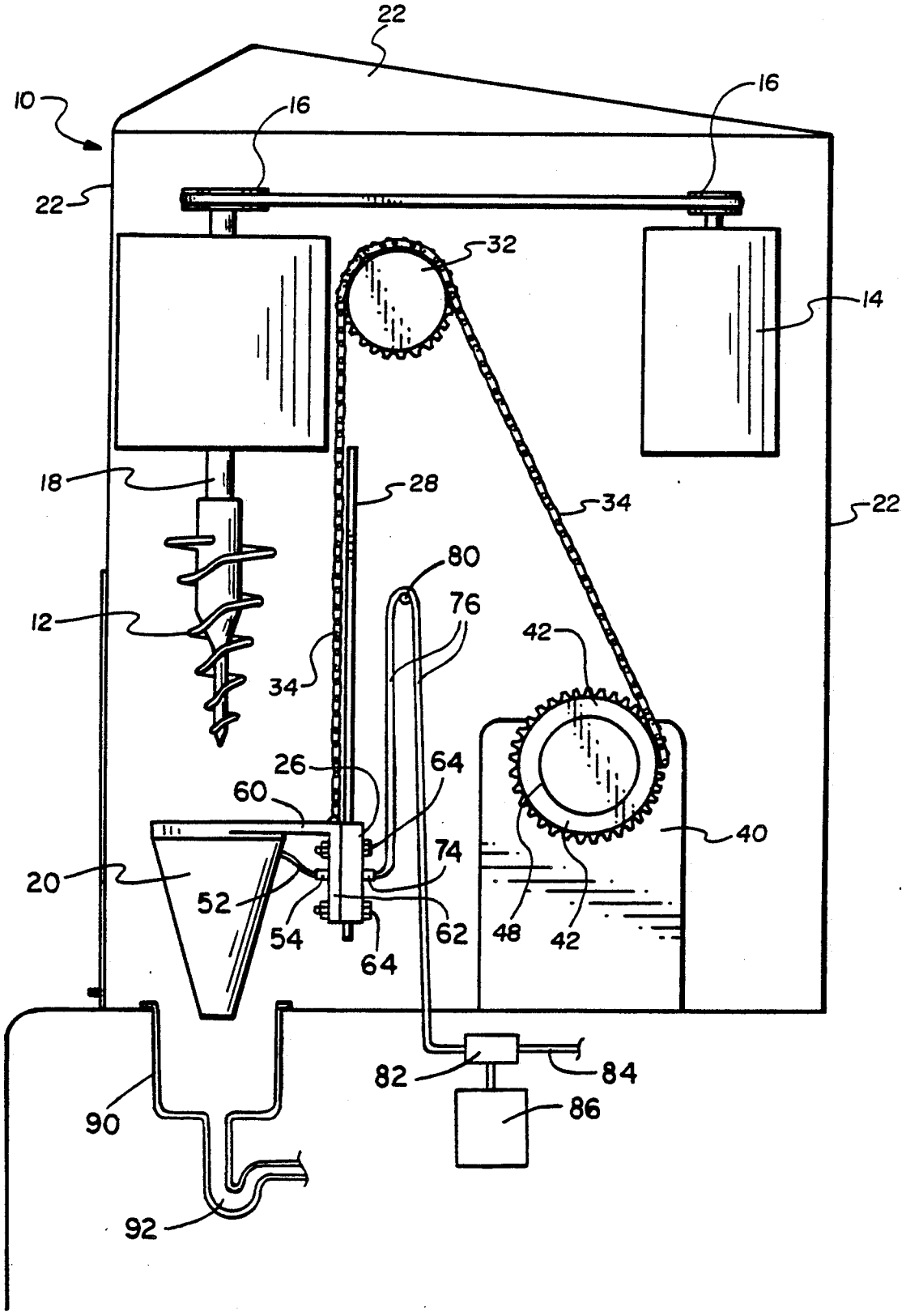
FIG. 2 is a side view of a mixing machine similar to that of FIG. 1 with the side of the housing of the mixing machine removed and with the bottom portion shown in section to illustrate working components within the housing.

As shown in FIGS. 2, 3 and 4, the mixing cone 20 is connected by a short connector 60 to a mounting plate 62. The mounting plate 62 is in turn held firmly to the carriage 26 by mounting attachments such as bolts and nuts 64. The mounting plate 62 sits flatwise firmly against the flat outer surface of the carriage 26. The coupling member 54 comprises a hollow cylindrical member firmly attached to the mounting plate 62, with the axis of the coupling member 54 being essentially perpendicular to the mounting plate 62. The short conduit 52 is connected in flow communications between one end of the coupling member 54 and the manifold 50, and the other end of the coupling member is open through the mounting plate 62.

As best shown in FIG. 4, at least one, and preferably two, retainer screws 66 are located between the ends of the coupling member 54. The retainer screws 66 are threaded through openings in the side of the coupling member 54 such that the ends of the retainer screws 66 extend into the inner cylindrical cavity of the coupling member 54. Washers 68 seal the heads of the retainer screws 66 to the coupling member 54 to prevent leakage of fluid from the coupling members 54 around the retainer screws 66. A coil spring 72 is positioned in the end of the coupling member 54 from which the conduit 52 extends. A ball 70 is positioned between the spring and the retainer screws 66. The retainer screws 66 retain the ball 70 within the coupling member 54 when the mounting plate 62 is removed from the carriage 26.

As shown in FIG. 4, the carriage 26 has a nipple 74 which extends through the carriage 26. One end is adapted to receive a supply conduit 76 that feeds the cleaning and sanitizing solution to the coupling member 54. The other end of the nipple 74 extends from the flat face of the carriage 26 to which the mounting plate 62 is mounted. The other end of the nipple 74 is adapted to be received snugly within the open end of the coupling member 54 when the mounting plate 62 is mounted to the carriage 26. One or two O-rings 78 can be provided in annular races in the end of the nipple 74 to form a fluid tight seal between the nipple 74 and the coupling member 54.

The ball 70 in the coupling member 54 seats against the open end of the nipple 74 and prevents backflow of fluid from the coupling member 54 into the supply conduit 76. When cleaning and sanitizing solution is delivered under pressure to the nipple 74, the ball 70 is pushed against the spring bias away from the end of the nipple 74, and cleaning and sanitizing solution is allowed to pass through the coupling member 54 and short conduit 52 to the manifold 50 to be sprayed into the mixing cone 20.

When it is desirable to dismantle and clean the coupling member 54, the mounting plate 62 is removed from the carriage 26. The retaining screws 66 retain the ball 70 and spring 72 within the coupling member 54 during this operation. Once the mounting plate 62 has been removed from the carriage 26, the interior of the coupling member is accessible for cleaning. The ball 70 and spring 72 can be removed for cleaning if desired by removing the retaining screws 66.

As shown in FIG. 2, the supply conduit 76, which is made of a flexible tubing, is looped over a retainer pin 80 which is located between the travel of the carriage 26 on the track 28. This allows the tubing 76 to move with the carriage 26 as the carriage 26 moves back and forth along the track 28. The end of the tubing 76 remote from the carriage 26 is advantageously connected to a mixing valve 82. The mixing valve 82 is connected to a water line 84 containing water under pressure. When the valve 82 is turned on to initiate the cleaning and sanitizing cycle, water flows through the valve 82 and is mixed with a sanitizing agent from a storage container 86. The sanitizing agent mixes with the water to form the cleaning and sanitizing solution as the water and sanitizing agent flow through the mixing valve 82 and supply conduit 76.

A catch basin or sink 90 is advantageously provided immediately below the mixing cone 20 when the mixing cone is in its lowermost position. The sink 90 catches any drippage from the mixing cone 20 during normal use in making frozen desserts. In addition, the sink collects the cleaning and sanitizing solution as it drains from the mixing cone 20 during the cleaning and sanitizing step. The sink 90 is advantageously connected through a conventional trap 92 to a drain waste vent system. If a drain waste vent system is not available, the sink 90 could be connected to a collection vessel or tank (not shown) which would then be periodically emptied when necessary.

Although preferred embodiments of the mixing machine of the present invention have been illustrated and described, it is to be understood that the present disclosure is made by way of example and that various other embodiments are possible without departing from the subject matter coming within the scope of the following claims, which subject matter is regarded as the invention.

We claim:

1. In a frozen dessert mixing machine including a mixing auger, a motor driven system for rotating the auger, a mixing cone in coaxial alignment with the mixing auger, and drive means for moving the mixing cone in linear movement toward and away from said auger, said improvement comprising at least one orifice in a sidewall of the mixing cone; and means for delivering a fluid through said orifice as the cone and the orifice are moved up and down adjacent to said auger to introduce said fluid into the interior of the mixing cone and to spray said fluid over the auger as the orifice moves along the axial dimension of the auger.

2. The improvement in a frozen dessert mixing machine in accordance with claim 1, wherein the fluid is a cleaning and sanitizing solution, whereby as the mixing cone is moved up and down, the cleaning and sanitizing solution is sprayed into the mixing cone and impinges on the auger to clean and sanitize the auger and the interior of the mixing cone.

3. The improvement in a frozen dessert mixing machine in accordance with claim 2, wherein said means for delivering the cleaning and sanitizing solution comprises a manifold having a hollow interior, said manifold positioned adjacent to the exterior surface of the sidewall of the mixing cone;

a conduit for delivering the cleaning and sanitizing solution under pressure into the hollow interior of the manifold; and said orifice in the sidewall communicates with the hollow interior of the manifold so that cleaning and sanitizing solution is sprayed through the orifice into the mixing cone.

4. The improvement in a frozen dessert mixing machine in accordance with claim 3, wherein a check valve is provided in the conduit for preventing backflow of material from the mixing cone through the check valve into said conduit.

5. The improvement in a frozen dessert mixing machine in accordance with claim 3, wherein the manifold is elongate and a plurality of orifices are provided in the sidewall of the mixing cone to communicate with the hollow interior of the manifold.

6. The improvement in a frozen dessert mixing machine in accordance with claim 3, wherein the mixing cone is attached to a mounting plate;

the mounting plate is mounted to a carriage that moves the mixing cone in its linear movement toward and away from the auger; and a coupling member is associated with the mounting plate and the carriage for coupling a flexible supply tube to the conduit for delivering the cleaning and sanitizing solution from the supply tube to the conduit.

7. The improvement in a frozen dessert mixing machine in accordance with claim 6, wherein a check valve is provided in the coupling member for preventing backflow of material from the mixing cone through the check valve into the flexible supply tube.

8. The improvement in a frozen dessert mixing machine in accordance with claim 3, wherein a catch basin is positioned below the mixing cone for catching drippings and the cleaning and sanitizing solution coming from the mixing cone; and a disposal conduit is connected to the catch basin for disposal of the drippings and the cleaning and sanitizing solution.

* * * * *